US005107878A

United States Patent [19]

Young

[11] Patent Number: 5,107,878

[45] Date of Patent: Apr. 28, 1992

[54] ARTICLE HANDLING APPARATUS

[76] Inventor: Peter D. Young, Les Blicgs, St. Andrews, Guernsey, Channel Islands, Channel Islands

[21] Appl. No.: 466,418

[22] PCT Filed: Sep. 5, 1988

[86] PCT No.: PCT/GB88/00722

§ 371 Date: Mar. 7, 1990

§ 102(e) Date: Mar. 7, 1990

[87] PCT Pub. No.: WO89/02319

PCT Pub. Date: Mar. 23, 1989

[30] Foreign Application Priority Data

Sep. 7, 1987 [GB] United Kingdom ..... 8721026
Mar. 29, 1988 [GB] United Kingdom ..... 8807473

[51] Int. Cl.[5] ..... B08B 3/02

[52] U.S. Cl. ..... 134/153; 134/157; 366/213

[58] Field of Search ..... 134/76, 120, 153, 157, 134/159; 366/63, 213; 68/140; 51/164.1; 248/141; 118/303, 418, 500

[56] References Cited

U.S. PATENT DOCUMENTS 881,583 3/1908 Hodgkins ..... 51/164.1
1,166,833 1/1916 Hazard ..... 248/141
3,746,316 7/1973 Langen et al. ..... 366/213
4,100,616 7/1978 Wilson ..... 366/213
4,468,129 8/1984 McIntosh et al. ..... 366/213

FOREIGN PATENT DOCUMENTS 2153863 2/1985 United Kingdom .
2174624 4/1986 United Kingdom .

*Primary Examiner*—Philip R. Coe
*Attorney, Agent, or Firm*—Oblon, Spivak, McClelland, Maier & Neustadt

[57] ABSTRACT

An article handling apparatus including a holder into which an article can be lowered and from which it can be lifted and which can rotate the article about a substantially horizontal axis, the article including a projection on at least one side of the article, the holder including a member rotatable about the axis and having a radially outwardly open channel for receiving the projection when the article is lowered into position, in the channel in response to a predetermined rotary movement of the member and the article away from the loading and unloading position such that the article is securely held during rotation. The preferred use is for holding baskets of impregnated castings in an enclosure for draining, cold water washing or hot water curing.

17 Claims, 7 Drawing Sheets

ARTICLE HANDLING APPARATUS

TECHNICAL FIELD

This invention concerns an article handling apparatus comprising a holder into which an article can be lowered and from which it can be lifted and which can rotate the article about a substantially horizontal axis.

BACKGROUND ART

One such apparatus is described with reference to and is shown in FIGS. 5 and 6 of our copending UK Patent Application No. 8610323 (2174624). There the article is a rectangular frame basket with metal mesh walls which contains metal castings for impregnation and the holder comprises a cylindrical rotary cage in which the basket is pre-mounted, and a pair of yokes for holding and rotating the cage part of which yokes can be pivoted back in the unloading and loading position to provide an unloading and loading opening.

Reference is also made to UK Patent Specification No. 2153863 which describes an apparatus in which a similar type of basket is lowered into an impregnation autoclave such that a lug towards the top of one side of the basket enters a V-shaped support member for the basket. The autoclave is then closed and a vacuum drawn, following which the support member gradually descends into a liquid impregnant bath at the bottom of the autoclave. After impregnation the basket is lifted out of the autoclave. However, there is no provision for rotation of the basket.

DISCLOSURE OF THE INVENTION

Generally stated, the invention provides an automatic catch for holding an article in a rotary holder.

According to the invention, there is provided an article handling apparatus comprising a holder into which an article can be lowered and from which it can be lifted and which can rotate the article about a substantially horizontal axis, the article comprising a projection on at least one side of the article, the holder comprising a member rotatable about the axis and having a radially outwardly open channel for receiving the projection when the article is lowered into position, and catch means for automatically holding the projection in the channel in response to a predetermined rotary movement of the member and the article away from the loading and unloading position such that the article is securely held during rotation. In one embodiment there is a projection on one side of the article and there is a preferably substantially central bearing pin which lies on the rotary axis on the other side of the article, the holder comprising an arcuate upwardly facing bearing surface in which the bearing pin rests when the article is lowered into position.

It is desirable that the article is fixed relative to the rotatable member at more than one point. Although this could be achieved by elongating the projection in the radial direction it is preferred to provide the rotatable member with a vertical channel for receiving the adjacent end of the article. Alternatively the rotary member may have a projection radially inward of the channel for engaging a vertical groove in the article.

In another embodiment, the holder also comprises rotatable support means for supporting the side of the article remote from the rotatable member and the support means comprises a frame into which the article can be lowered, the frame being secured to the rotatable member on one side and being carried by a bearing on the other side.

Normally the projection on the article is displaced upwardly from the rotary axis as this facilitates location of the article during loading but it could be at any other convenient location (including on the axis provided that provision is made for transferring rotary motion to the article). Preferably the catch means is held in its operative position by a cam follower lever which engages a fixed cam track, the cam track being such as to release the catch in the loading and unloading position. For example the catch may be a forked member carried by a horizontal shaft mounted in the rotatable member, the forked member being biased, e.g. by the weight of the cam follower lever which is also connected to the shaft, so that it is upwardly facing when in the loading and unloading position and when it is not engaged by an article projection. The lower arm of the fork can be omitted but in such a case the catch is applied and released during each rotation. Desirably the cam follower lever carries a roller to reduce wear.

The invention has been particularly developed for handling baskets of metal castings or sintered metal articles as described more fully in Patent Application No. 2174624, only in the present case the rectangular baskets are handled directly without the need for an intermediate cage. Preferably the baskets have pins and projections on two pairs of opposite sides so that the basket can be rotated about one horizontal axis in a first treatment step and rotated about a second horizontal axis at right angles to the first in a second treatment step, the basket being lifted out of the holder, e.g. with an overhead hoist, and rotated through a right angle about a vertical axis between the two steps. The apparatus of the present invention preferably includes a housing so that it may be used for impregnation, draining after impregnation, cold water washing or hot water curing as described in UK Patent Application No. 2174624, although in its simple form herein described it is most suitably cool water washing or hot water curing in which water is simply sprayed onto the basket since this simple form does not have include provision for lowering the rotary axis within the housing to facilitate impregnation and for raising it to facilitate drainage of excess impregnant. In one preferred arrangement the baskets are transferred successively between four successive Stations I–IV by an overhead hoist. Station I is an impregnating station as described in UK Patent Specification No. 2153863 and Stations II–IV are in accordance with the present invention, Station II being a drain station where the basket is rotated intermittently with a pause of a few seconds e.g. at 45° intervals, Station III being a cold water wash station and Station IV being a hot water cure station, water being sprayed into the top of the housing in Stations III and IV.

It would of course be possible to modify the invention so that both sides of the article are mounted in a similar way, e.g. by means of a projection held in a channel in a rotatable member by means of a catch.

BRIEF DESCRIPTION OF THE DRAWINGS

An embodiment of the invention will now be described by way of example with reference to the drawings in which.

BEST MODES FOR CARRYING OUT THE INVENTION

Figure 1:
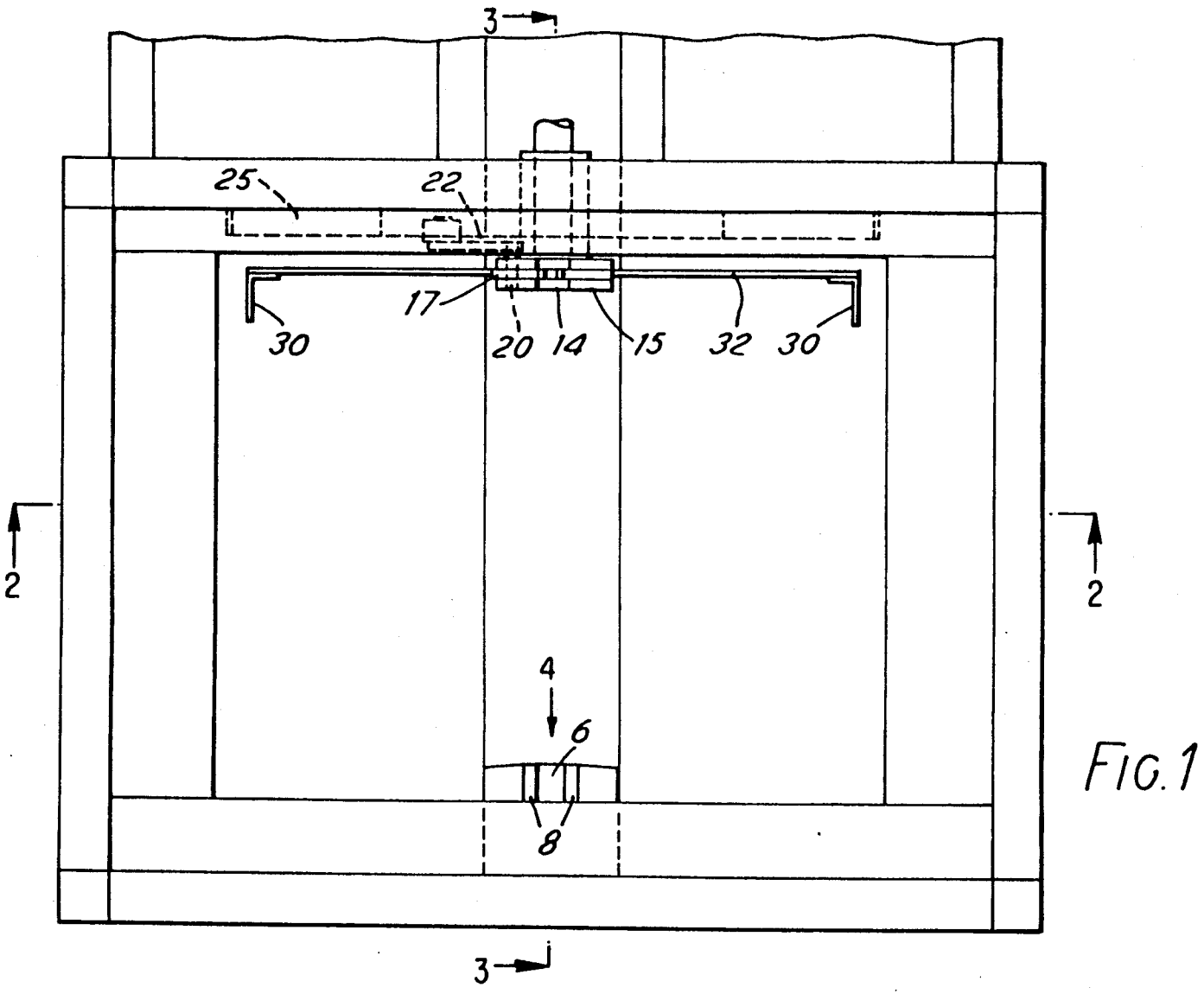
FIG. 1 is a plan view of apparatus for treating baskets of articles, with a cold or hot water spray.

The apparatus shown comprises a main housing 1 which is substantially rectangular in plan beneath which is a water collecting tank 2. Spray nozzles are provided in a pipe 3 at the top of the housing 1 and the housing 1 can be closed by a lid (not shown).

A bearing 5 for an axial pin on a basket (not shown) is provided by an arcuate upwardly facing bearing surface 6 welded to the housing wall. The bearing surface 6 has a lead-in channel 7 for the pin provided by a pair of walls 8 welded to the housing and diverging at their upper end.

Figure 5:
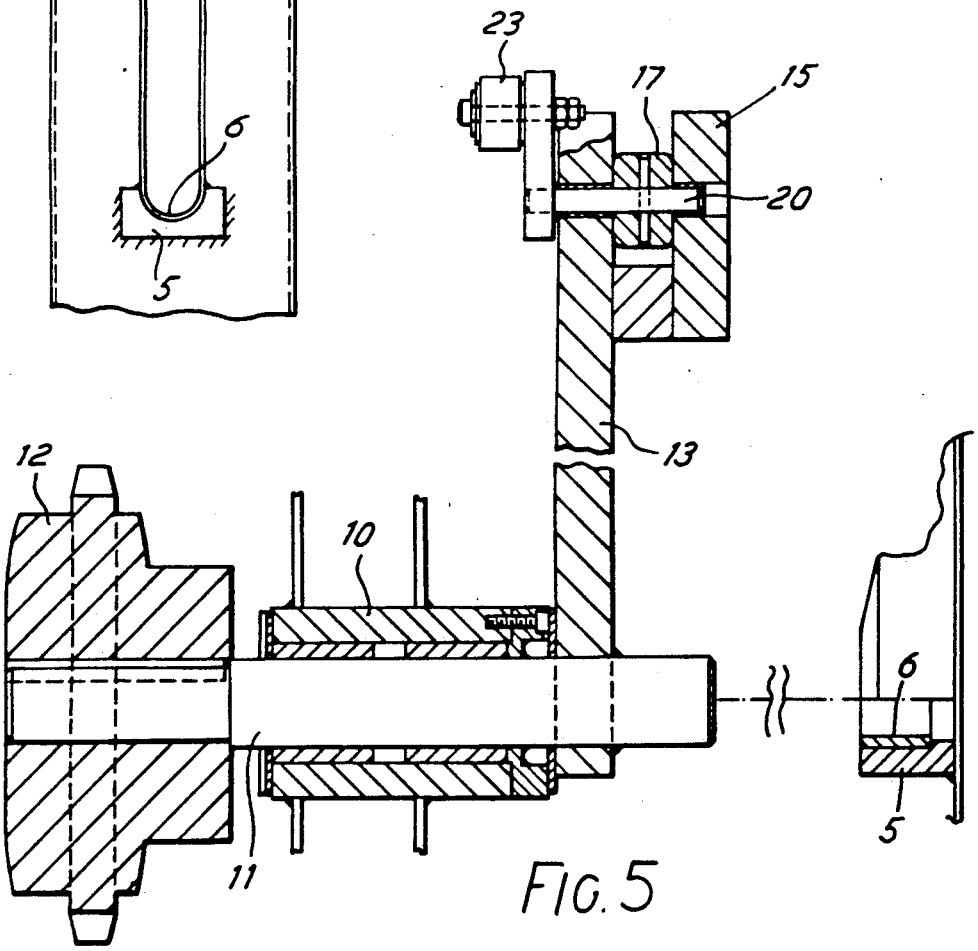
FIG. 5 is a detail view along line 5—5 but in the opposite direction to the arrows.

On the opposite side of the housing 1, a sealed bearing 10 in the housing wall carries a horizontal shaft 11 to the outer end of which is fixed a drive sprocket 12 which drives the shaft 11 through a slip clutch (not shown). A cam and cam follower switch (not shown) automatically permit the shaft 11 to be stopped in the loaded and unloaded position. An arm 13 is welded to the shaft 11 and provides a channel 14 (see FIG. 2) for a further pin on the basket at its radially outer end. As shown in FIG. 5 the arm 13 is forked at its radially outer end so that it provides an inner channel member 15 as well as an outer channel member provided by the arm itself. Disposed between the inner and outer channel members is a catch 17 in the form of a plate having a recess 18 in its end and a hole 19 by means of which it is fixed to a shaft 20.

The recess 18 intersects the channel 14 in the operative position shown so that the pin on the basket (not shown) lies in the recess 18.

Figure 2:
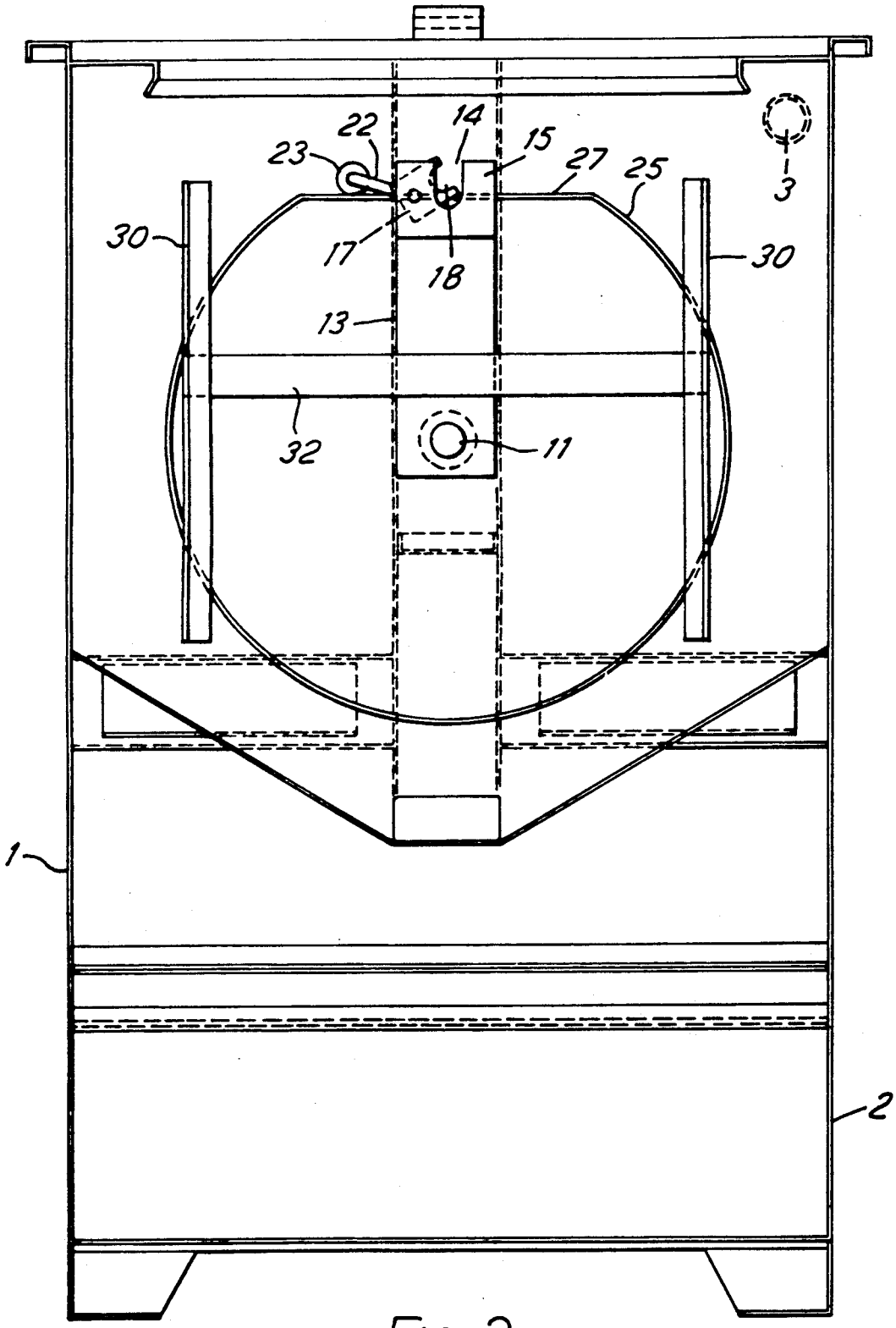
FIG. 2 is a vertical section of the apparatus of FIG. 1 on line 2—2.
Figure 3:
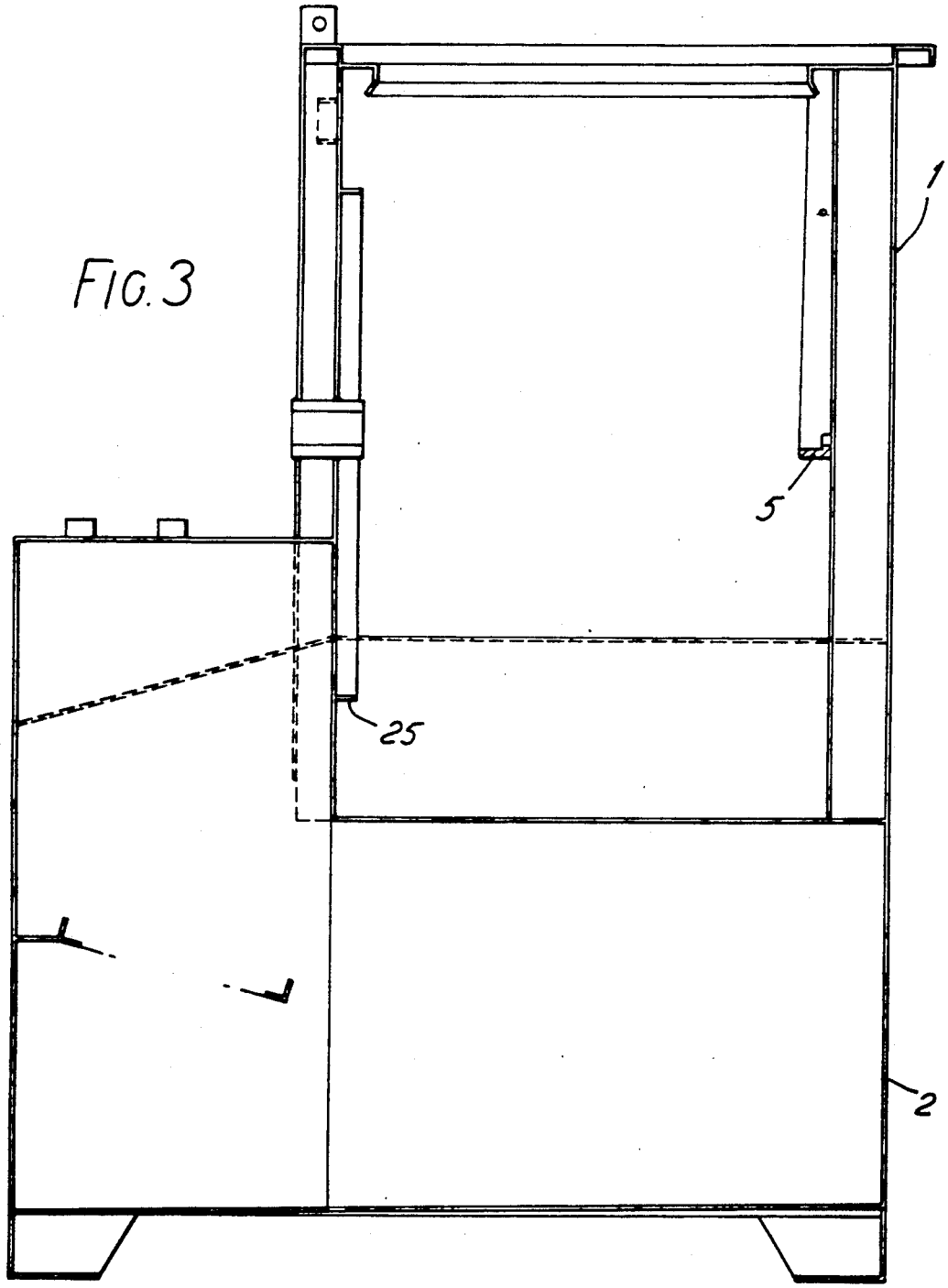
FIG. 3 is a vertical section of the apparatus of FIG. 1 on line 3—3 (but omitting the rotating parts)
Figure 4:
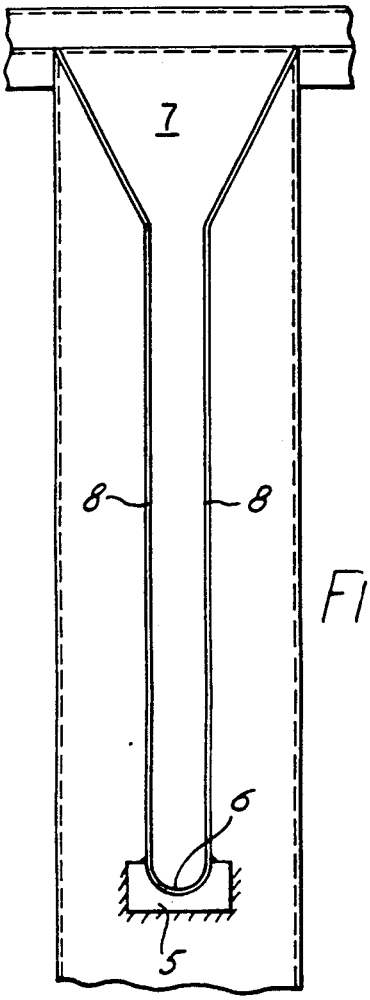
FIG. 4 is a detail view of some of the rotating parts (in the same direction as FIG. 3); taken in the direction of arrow 4 in FIG. 1.
Figure 6:
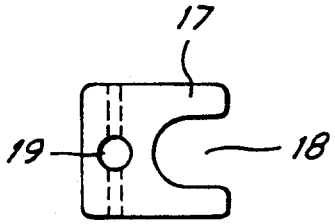
FIG. 6 is a detail view of the catch used in the apparatus.

The shaft 20 is rotatably carried in the two channel members and carries a lever 22 which in turn carries a cam follower roller (wheel) 23 at its free end. In the load and unload position shown the roller 23 is out of contact with its cam 25 which is a narrow plate welded to the housing wall. The cam 25 is generally circular but has a flattened (or interrupted) section 27 at one top. When the roller 23 is opposite the circular portion of the cam 25 it is held radially outwardly in such a way as to maintain the catch 17 in its operative position. When the roller 23 is opposite flattened section 27 the catch is free to pivot counterclockwise (as seen in FIG. 2) to such an extent that the mouth of the recess is inclined upwardly and corresponds with the pin receiving channel 14; a stop (not shown) is provided for this purpose and the weight of the lever 22 and roller 23 is sufficient to effect this rotation. When a basket is lowered into the housing, one pin thereof rests on bearing surface 6 and another pin descends into the channel 14 and rotates the catch 17 clockwise as it does so. The lid is placed on the housing, water is sprayed through the nozzles and the basket is rotated. In the load/unload position the pin is retained in the channel 14 by gravity but as the basket turns, the roller 23 engages the cam 25 and prevents the pin falling out of the channel 14. When the basket is stopped at the unload position, the catch 17 is automatically releasable as the basket is lifted out. In an alternative embodiment (not shown), two similar catches 17 are provided with respective shafts on each side of the channel 14; this provides additional security in case of particularly heavy articles.

To steady the basket, a pair of angle-iron members 30 are welded to a cross-beam 32 which is in turn welded to the arm 13, the members 30, the beam 32, and the bearing surface 6 together making up a holder for the basket. The members 30, which provide a shallow vertical channel, fit the outside of the basket fairly closely and prevent undue movement relative to the arm 13 during rotation. The angle-iron members 30 are desirably flared outwardly (not shown) at the top, and possibly also the bottom, to facilitate loading and unloading. It will be appreciated that a flared upper end facilitates alignment of the pin with the channel 14 as the basket is being lowered by the hoist.

In FIGS. 7-10 like numerals are used for like parts but are in a 100 series.

It will be seen that the catch has been simplified to a single plate 117 which provides the recess 118 and carries the roller 123. The channel member 15 is omitted.

Figure 7:
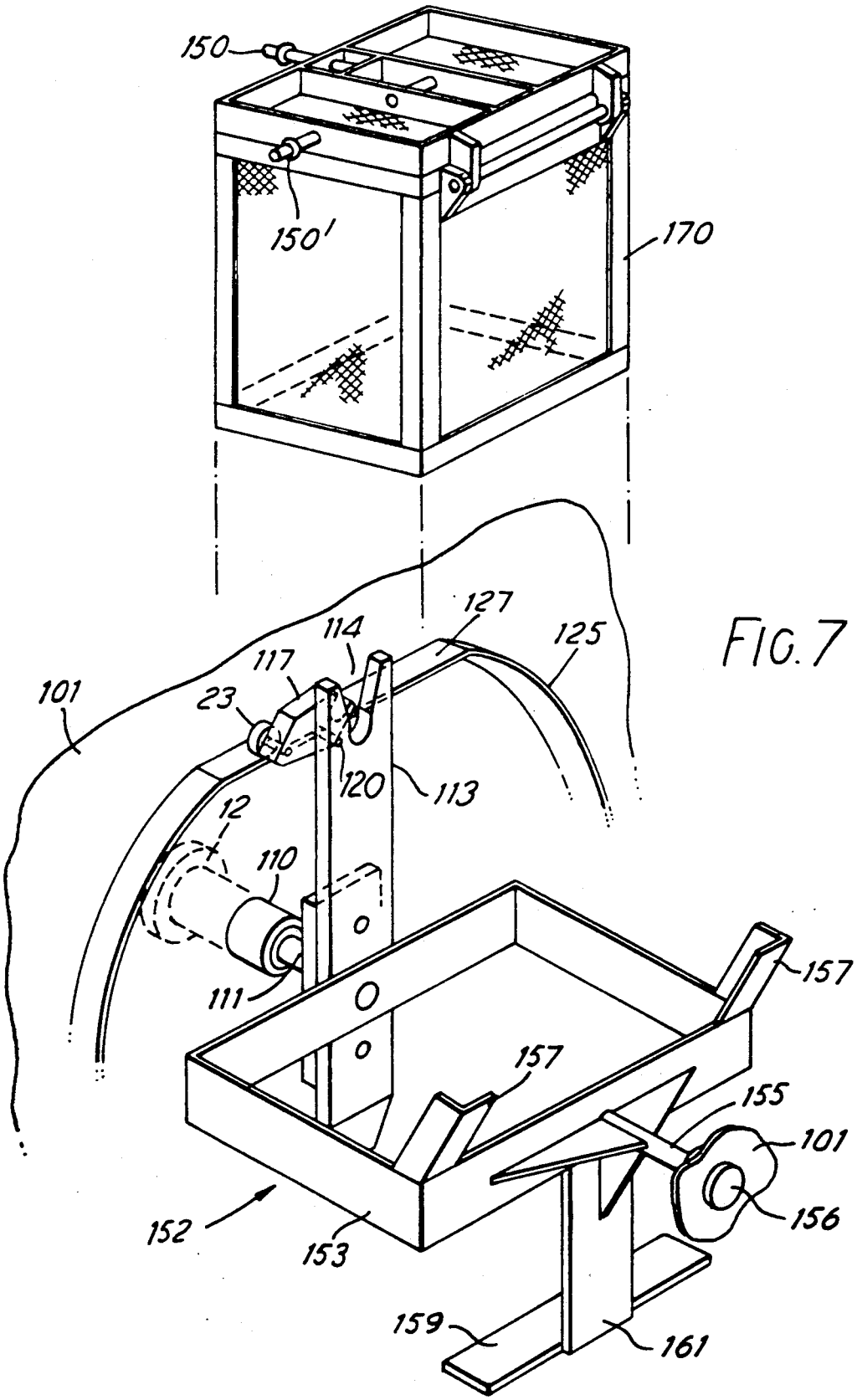
FIG. 7 is a third angle projection showing a second embodiment of the invention somewhat diagrammatically.
Figure 8:
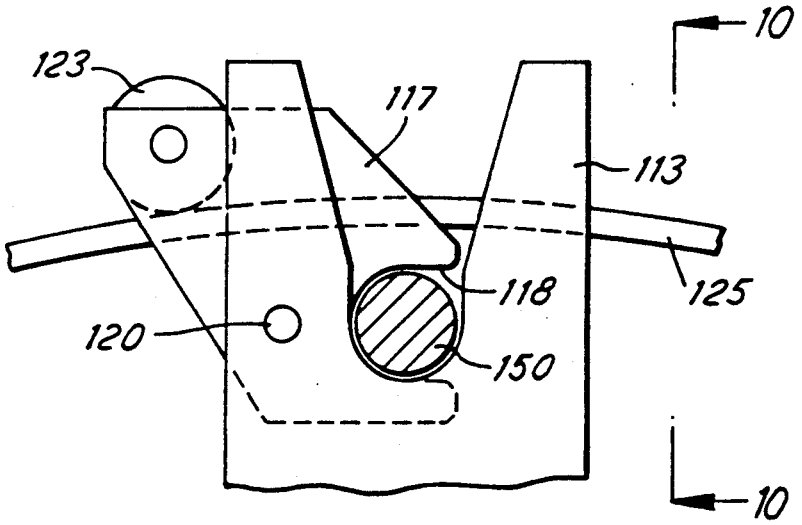
FIG. 8 is a detail elevation of the catch shown in FIG. 7 with a basket pin in place and the holder rotated away from the load/unload position so that the catch is operative.
Figure 9:
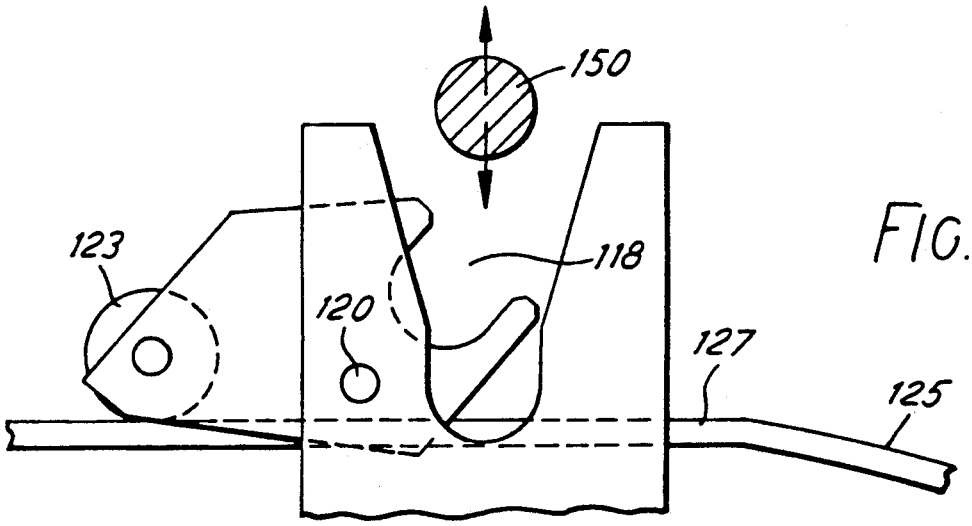
FIG. 9 is a similar view to FIG. 8 but showing the basket being loaded (or unloaded) in the load/unload position.
Figure 10:
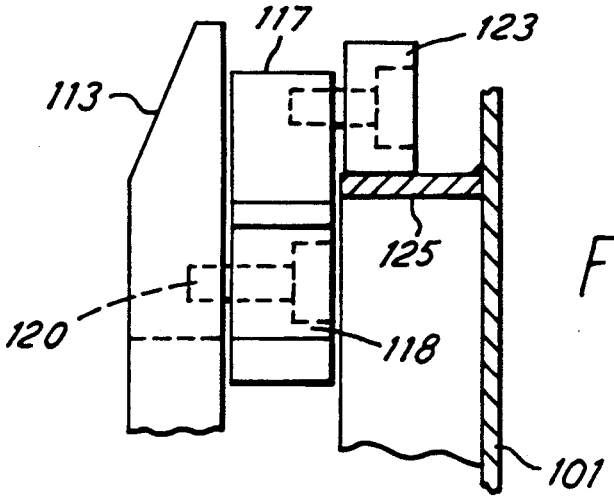
FIG. 10 is a section on line 10—10 of FIG. 8.

In FIGS. 7, 8 and 9 the pin on the basket is shown at 150.

In the FIG. 7 embodiment the rotary holder comprises the arm 113 (as in the FIG. 1 embodiment) but the angle-iron members 30 are replaced by a more complete support member 152 which obviates the need for a pin on the other side of the basket and an upwardly open bearing into which it can drop. The support member 152 comprises a rectangular frame 153 carried by and rotatable with the shaft 111 at one side and having an aligned stub shaft 155 at the other side; and the stub shaft is mounted in a bearing 156 similar to bearing 110. The frame 153 has a pair of upwardly directed outwardly inclined (in two planes) angle-iron guides 157 at least the two corners adjacent the stub shaft 155 (the arm 113 provides a guide on the other side of the frame). The stub shaft side of the frame 153 also has a basket stop plate 159 carried by a depending arm 161.

In the embodiment shown in FIG. 7, the basket 170 has a square cross-section and two pins 150 and 150' are provided on adjacent sides. The two pins allow the basket to be loaded into the rectangular frame 153 in one of two possible positions and, when required, reloaded into a second position following rotation through a right angle about a vertical axis.

The operation of the FIG. 7 embodiment is essentially similar to the FIG. 1 embodiment.

Figure 11:
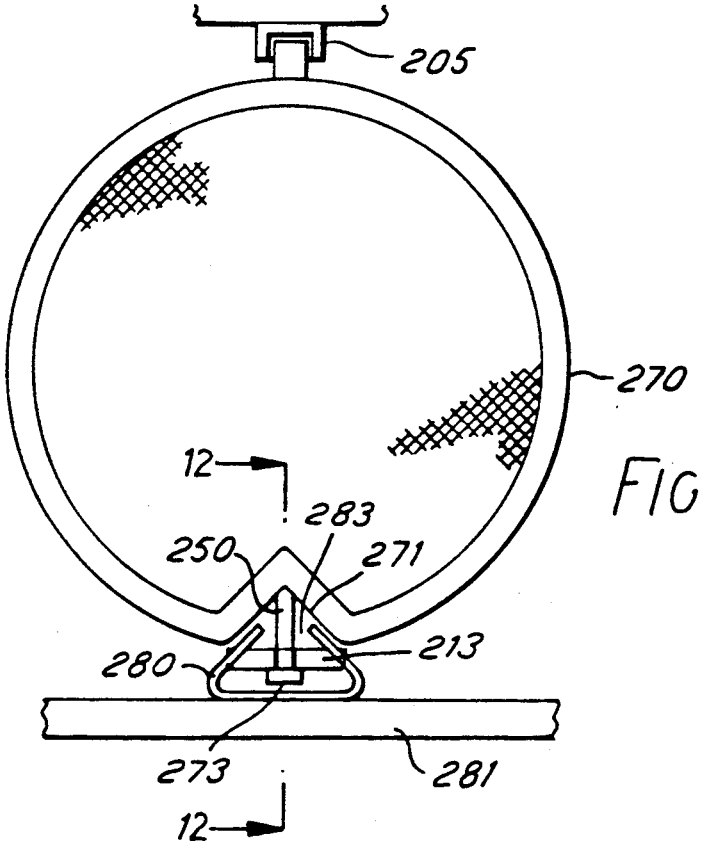
FIG. 11 is a diagrammatic plan view showing a modification of the embodiment of FIGS. 1-6.
Figure 12:
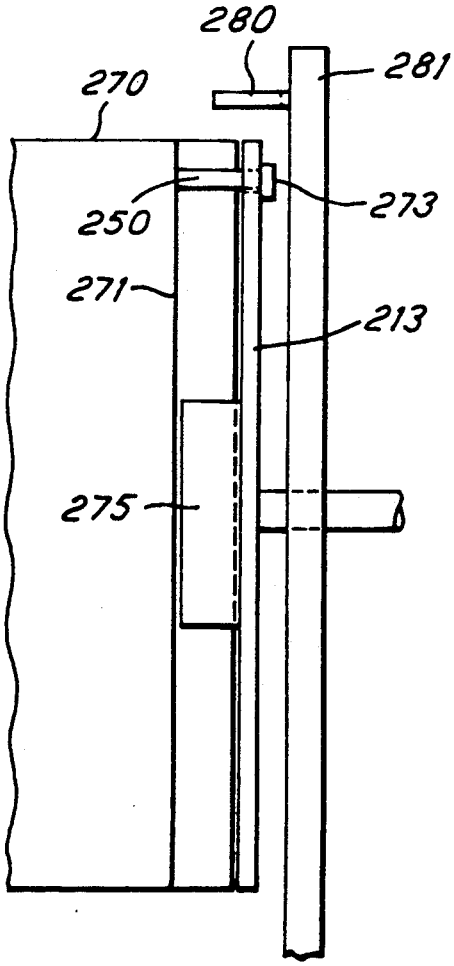
FIG. 12 is a vertical section corresponding to line 12—12 of FIG. 11.

In the embodiment shown in FIGS. 11 and 12, the basket 270 is in the form of a vertical cylinder with a V-shaped groove 271 down one side. Within the top of the groove 271 is a pin 250 but this pin 250 has a head 273. The arm 213 in this case also has a vertical blade like projection 275 which engages in the groove 271 when the basket 270 is lowered into position so that rotation of the arm 213 positively rotates the basket 270. For simplicity the catch is not shown in FIGS. 11 and 12 but its structure and operation are as in FIGS. 1–6. A guide member 280 of approximately triangular shape is fixed to a frame member 281 and serves to align the groove 271 as the basket 270 is lowered. The guide member 280 has a slot 283 to permit passage of the pin 250.

Obviously, numerous modifications and variations of the present invention are possible in light of the above teachings. It is therefore to be understood that within the scope of the appended claims, the invention may be practiced otherwise than as specifically described herein.

I claim:

1. An article handling apparatus, which comprises:

a holder for supporting an article, said holder having at least one side for supporting the article on a substantially horizontal axis, the article including a projection on at least one side thereof, the holder including a rotary member and having an open channel for receiving the projection, and catch means for automatically holding the projection in the channel in response to a predetermined rotary movement of the rotary member and the article such that the article is securely held during rotation.

2. Apparatus according to claim 1, wherein the article has a second side opposite the at least one side and a rotary bearing pin on the second side, wherein the holder comprises an arcuate upwardly facing bearing surface on which the bearing pin rests when the article is lowered on said holder.

3. Apparatus according to claim 2, wherein the rotary member has a vertical channel for receiving a side of the article which neighbors the vertical channel.

4. Apparatus according to claim 1 or 2, wherein the rotary member has means for engaging the article.

5. Apparatus according to claim 1 or 2, wherein the article has a groove formed therein and the rotary member has a projection for engaging the groove in the article.

6. Apparatus according to claim 5, wherein the apparatus comprises a fixed guide for engaging the groove in the article and having a slot through which the projection of the article passes.

7. Apparatus according to claim 1, wherein the holder also comprises support means for supporting a side of the article remote from the rotary member.

8. Apparatus according to claim 7, wherein the holder support means comprises a frame into which the article is positioned, the frame being secured to the rotary member and being carried by a bearing.

9. Apparatus according to claim 1, 7 or 8, wherein the channel in the rotary member is displaced upwardly from the horizontal axis.

10. Apparatus according to claims 1, 7 or 8, wherein the catch means comprises a cam follower lever for holding the catch means and a fixed cam track which cooperates with said cam follower lever and wherein the cam track includes means for releasing the catch.

11. Apparatus according to claim 10, wherein the cam follower lever comprises roller means for engaging the cam track.

12. Apparatus according to claim 11, wherein the catch means comprises a forked member carried by a horizontal shaft mounted in the rotary member, the forked member being biased so that it is upwardly facing when in a loading and an unloading position and when it is not engaged by an article projection.

13. Apparatus according to claim 12, wherein the forked member is biased by the weight of the cam follower lever which is also connected to the shaft.

14. Apparatus according to claims 1, 7 or 8, which comprises guide means for guiding the article upon being lowered onto said holder in such a way that the projection is brought into alignment with the channel.

15. Apparatus according to claim 1, 7 or 8, which comprises a housing within which the holder is positioned and means for treating the article with liquid while the article is positioned in the housing.

16. Apparatus according to claims 1, 7 or 8, which comprises a basket within which objects are positionable, said basket containing one of metal castings and sintered metal articles.

17. Apparatus according to claim 16, which comprises means for lifting the basket from the holder, turning the basket through a right angle about a vertical axis and lowering the basket into the holder for rotation about an axis at a right angle to an axis of rotation.

* * * * *